United States Patent [19]

Okamoto

[11] 4,035,582

[45] July 12, 1977

[54] TREMOLO EFFECT PRODUCING SYSTEM

[75] Inventor: Shimaji Okamoto, Hamamatsu, Japan

[73] Assignee: Nippon Gakki Seizo Kabushiki Kaisha, Hamamatsu, Japan

[21] Appl. No.: 588,650

[22] Filed: June 19, 1975

Related U.S. Application Data

[62] Division of Ser. No. 365,518, May 31, 1973, abandoned.

[30] Foreign Application Priority Data

| | | |
|---|---|---|
| June 12, 1972 | Japan | 47-58414 |
| June 29, 1972 | Japan | 47-65193 |
| June 29, 1972 | Japan | 47-65194 |
| July 1, 1972 | Japan | 47-66000 |

[51] Int. Cl.[2] ..... G10H 1/04

[52] U.S. Cl. ..... 179/1 J; 84/1.25; 181/143

[58] Field of Search ..... 179/1 J; 84/1.25, DIG. 4; 181/143

[56] References Cited

U.S. PATENT DOCUMENTS

| | | | |
|---|---|---|---|
| 2,287,105 | 6/1942 | Kannenberg | 179/1 J |
| 2,450,139 | 9/1948 | Hartsough | 84/1.25 |
| 2,869,669 | 1/1959 | Leslie | 84/1.25 |
| 3,346,070 | 10/1967 | Hare | 181/143 |
| 3,385,394 | 5/1968 | Gundlach | 181/143 |
| 3,716,648 | 2/1973 | Takeyama | 84/1.25 |
| 3,876,834 | 4/1975 | Suzuki | 179/1 J |
| Re. 23,323 | 1/1951 | Leslie | 179/1 J |

*Primary Examiner*—Douglas W. Olms
*Attorney, Agent, or Firm*—Cushman, Darby & Cushman

[57] ABSTRACT

A tremolo effect producing system comprises at least one electro-acoustic transducer such as a loudspeaker for converting an electrical audio signal to a sound, at least one acousto-electrical transducer such as a microphone for converting sound to an electrical signal and disposed so as to face the loudspeaker, and at least one sound shielding member rotatably mounted between the above-mentioned two transducers and having sound transmitting openings or cutouts whereby sounds from the speaker will be periodically and/or individually interrupted with fade-in and fade-out effects as said member is rotated. These transducers and sound shielding member are sealed in a closed housing. Thereby the sound wave emitted from the speaker through the openings or cutouts of the rotating member is converted to an electrical signal with natural tremolo effects by the microphone. The thus-produced signal may be mixed with an audio signal with non-tremolo effect and amplified and reproduced by a loudspeaker.

6 Claims, 28 Drawing Figures

PRIOR ART
FIG. 1
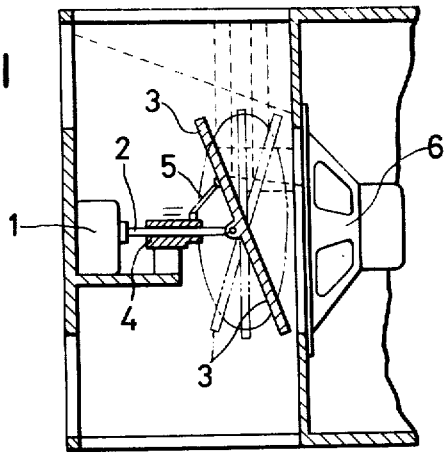
PRIOR ART
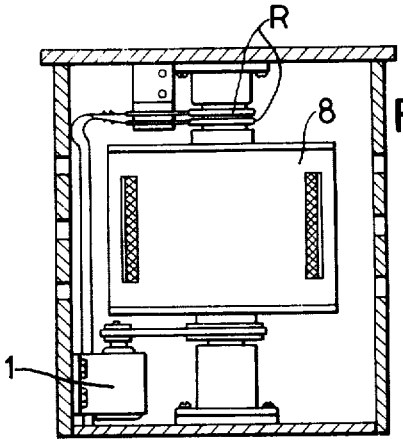
FIG.4
FIG. 2
PRIOR ART
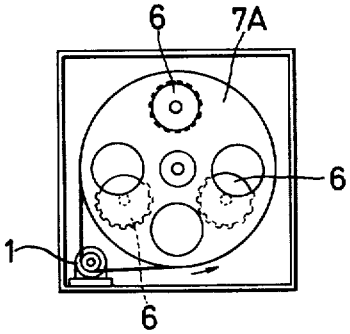
FIG. 5
PRIOR ART
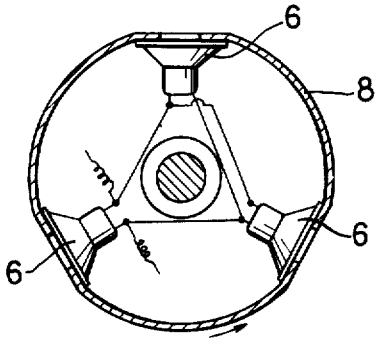
FIG. 3
PRIOR ART
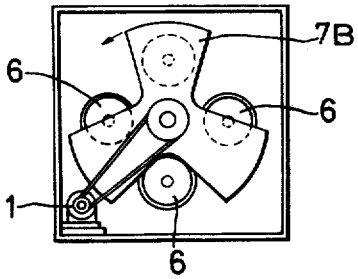

TREMOLO EFFECT PRODUCING SYSTEM

This is a division of application Ser. No. 365,518 filed May 31, 1973, now abandoned.

BACKGROUND OF THE INVENTION

1. Field of the invention

The present invention relates to sound reproducing systems for producing tremolo effects, and, more particularly, to novel tremolo effect producing systems most suitable for use with electronic musical instruments.

2. Description of the Prior Art

As the conventional sound reproducing system for producing a tremolo effect on sounds as they are generated by an electronic musical instrument, there is known the type having a rotational disc located in front of a loudspeaker or speakers to thereby provide a tremolo effect, as disclosed in, for example, Japanese Utility Model Publication No. 22436/1965 and U.S. Pat. No. 3,204,722.

Said Utility Model Publication, as shown in FIG. 1, discloses a tremolo effect producing apparatus comprising a motor 1, a rotational shaft 2 operatively connected with the motor, an acoustic reflecting plate 3 of which the center is supported by the end of the shaft so as to be rotatable in any plane involving the shaft, a bearing 4 slidably engaged with the shaft 2, a connecting lever 5 connecting the bearing 4 with the side portion of the relfecting plate 3, and a loudspeaker 6 in front of which is located the reflecting plate 3 so as to face it, whereby the sounds from the speaker provides a tremolo effect through the reflecting plate as the plate is rotated with respect to the direction of the shaft, namely, axially of the loudspeaker.

Said U.S. patent, as shown in FIGS. 2 and 3, discloses another system for generating a tremolo effect on the sound waves from speakers including a sound reproducing speaker enclosing cabinet, a vertically disposed speaker supporting panel spaced inwardly from an open side of the cabinet, a plurality of sound reproducing speakers 6 mounted on the panel, a rotating disc 7A spaced from and operating in a plane parallel with the speaker supporting panel and having openings corresponding in diameters with the diameters of the diaphragms of the speakers or a rotating plate 7B having cutouts and a motor for rotating the disc or the plate at a required revolution speed.

Other known device of the type in which a plurality of speakers are rotated in a plane to produce a tremolo effect is referred to in the following two U.S. patents. That is, U.S. Pat. No. 3,100,024, as shown in FIGS. 4 and 5, discloses an apparatus for producing vibrato or tremolo effects, comprising a motor 1, a drum 8 arranged on the inside of a peripheral wall on which a plurality of speakers 6 are revolvably mounted for rotation about an axis, the drum being operatively connected with the motor through a belt so as to be rotated, and slip rings R through which low frequency currents are supplied to the respective speakers, whereby the sounds from the speakers are given vibrato or tremolo effects as the speakers are horizontally rotated in the same plane with that of rotation of the drum driven by the motor.

As shown in FIG. 6, U.S. Pat. No. 3,084,585 indicates an acoustic modulator comprising a speaker mounting disc 9 having circumferentially disposed plural speakers 6 which may be rotated about a horizontal axis, namely, circumferentially by means of a suitable motor MA and may be rotated about a vertical axis of a vertical standard IC, namely, perpendicularly to the vertically diametric direction of the disc, by means of another motor MB, to produce a Doppler effect and a tremolo effect.

However, these known tremolo effect producing systems have the following disadvantages.

First, the known tremolo effect producing apparatus are inconveniently bulky, occupying a large space, include complicated mechanisms and cannot effectively produce a tremolo effect when sound is reproduced by means of headphones in an electronic musical instrument. Furthermore, when incorporated in an electronic musical instrument, such an apparatus generally requires a fixed loudspeaker for sound reproduction having a non-tremolo effect, as well as a rotating loudspeaker for providing a tremolo effect, and also separate power amplifiers therefor.

Accordingly, such apparatus not only tend to be very expensive but also cannot radiate tremolo and non-tremolo sounds from the same speaker, resulting in the lack of naturalness of sound in the performance of the electronic musical instrument.

SUMMARY OF THE INVENTION

Therefore, it is an object of the present invention to provide a novel tremolo effect producing system, which is able to eliminate the abovementioned defects and which is widely adaptable as an electro-acoustic modulator.

Another object of the present invention is to provide a system for producing a tremolo effect which comprises a closed housing including at least one loudspeaker, at least one microphone disposed opposite thereto, and at least one rotatable sound shield member disposed between the loudspeaker and the microphone and having an opening or openings and/or a cutout or cutouts capable of transmitting the sounds coming from the loudspeaker, and a means for rotating the sound shield member at a desired speed of revolution, whereby an audio signal applied to the loudspeaker of the system is modulated and is picked up by the microphone as a sound signal having an interesting tremolo effect.

A further object of the present invention is to provide a tremolo effect producing system which is small in size or space-saving and is inexpensive to manufacture, and is able to dispense with a conventional loudspeaker which has been used only for obtaining a tremolo effect in an electronic musical instrument.

A still further object of the invention is to provide a system for producing a tremolo effect which is adaptable for a headphone as a sound reproduction system of an electronic musical instrument and will impart the sounds from the headphone with a tremolo effect having a sufficient depth.

Another object of the present invention is to provide a sound reproduction system with a specific tremolo effect producing housing member for generating an audio signal electro-acoustically modulated with a tremolo effect, which comprises, in combination, an acoustic transducer such as a loudspeaker for reproducing an audio signal into a sound, a sound shield member disposed in front of the loudspeaker and rotatable to transmit the sound from the loudspeaker forwardly through openings or cutouts provided in said member, and a pickup such as a microphone provided opposite to the loudspeaker through the shield member for picking up the thus modulated sound with a tremolo effect into an audio signal with said effect, whereby the signal resulting from the pickup is electrically processed with the audio signal having no tremolo effect and is reproduced into musical sound, so that the reproduced sound effect gives the listener a natural feeling and eliminates the impression of an artificial electrical sound image.

Other objects, features and advantages of the present invention will become apparent from the following detailed description of some specific embodiments thereof when taken in conjunction with the accompanying drawings.

BRIEF DESCRIPTIONS OF THE DRAWINGS

FIGS. 1 through 6 are views illustrating conventional tremolo effect producing means by way of examples.

Figure 6:
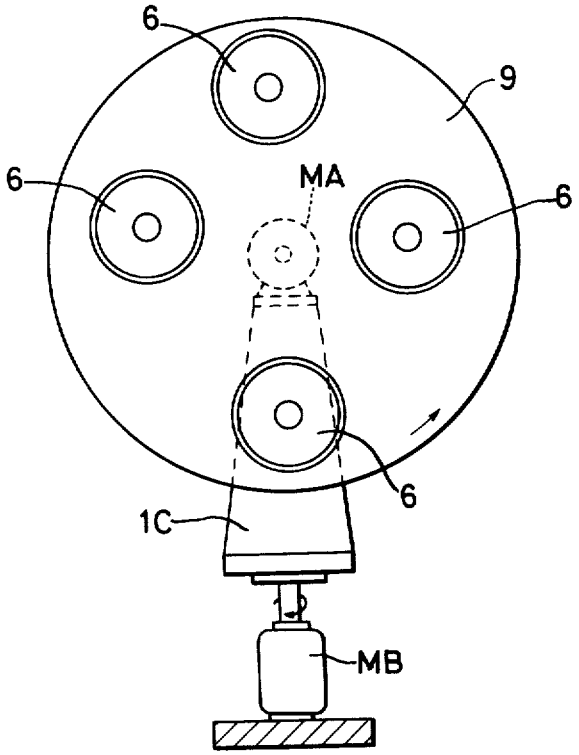
FIG. 6 PRIOR ART
Figure 7:
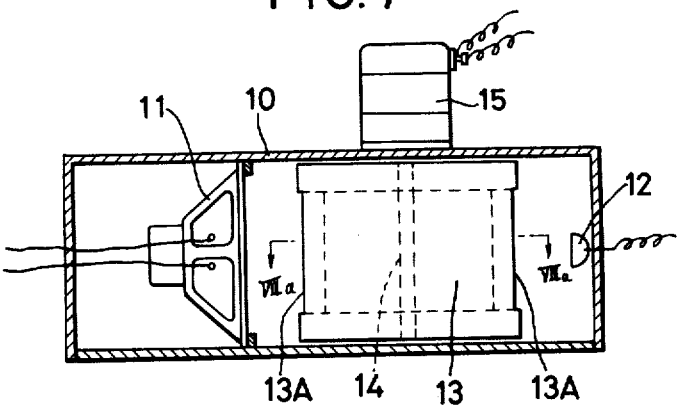
FIG. 7 is a partially sectional side view representing the structure of an essential portion of an embodiment of the present invention.
Figure 8A:
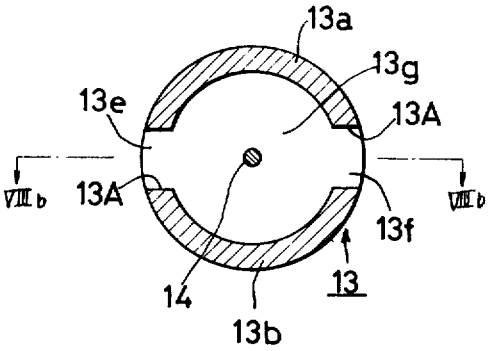
Figure 8B:
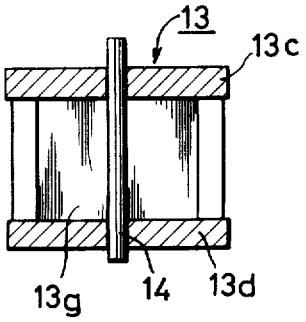

FIGS. 8*a* and 8*b* are sectional views of a rotating sound interrupting member used in the system of FIG. 7, respectively.

Figure 9:
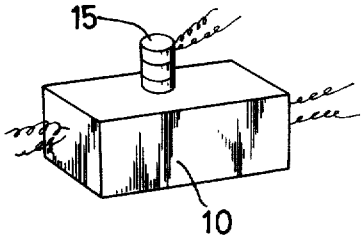
Figure 10A:
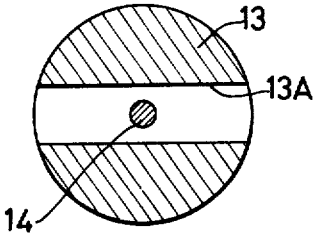
Figure 10B:
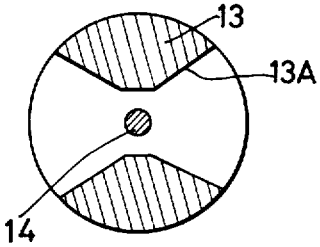
Figure 10C:
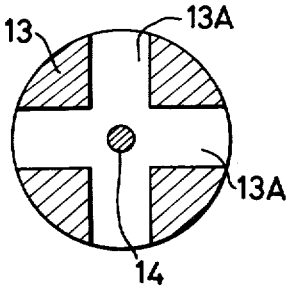
Figure 10D:
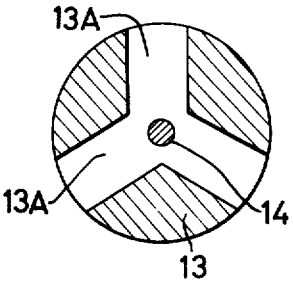

FIG. 9 is an oblique view for schematically illustrating the system shown in FIG. 7.

FIGS. 10*a*, 10*b*, 10*c* and 10*d* are sections of modifications of the rotating member shown in FIG. 8*a*.

Figure 11:
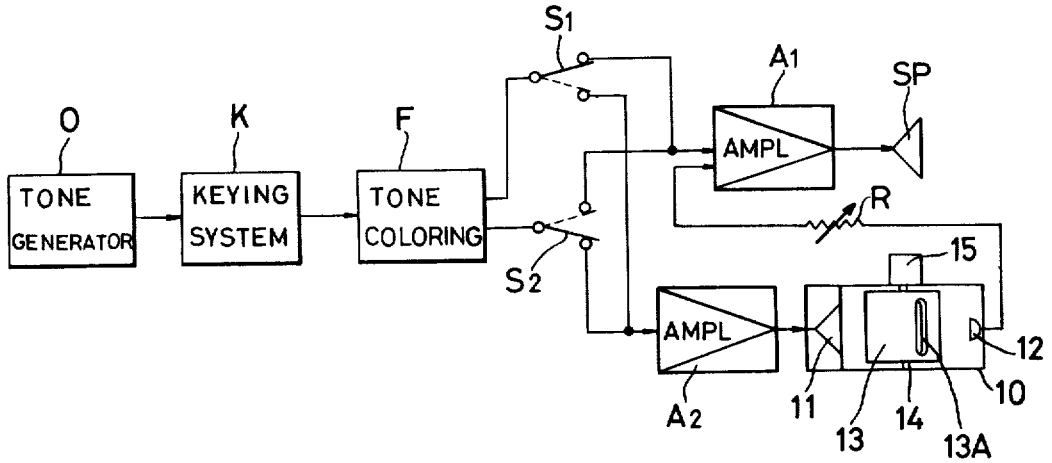

FIG. 11 is a schematic block diagram of an electronic musical instrument to which the present invention is applied.

Figure 12:
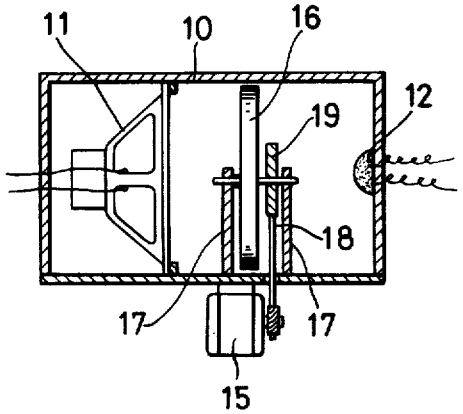

FIG. 12 is a sectional view illustrating a modification of the embodiment shown in FIG. 7.

Figure 13A:
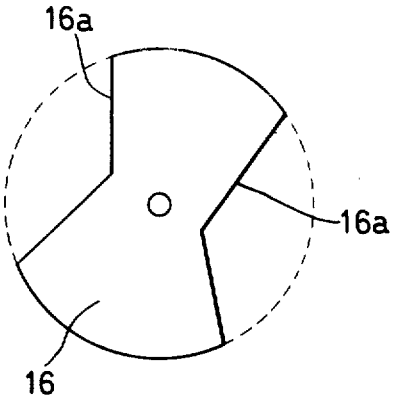
Figure 13B:
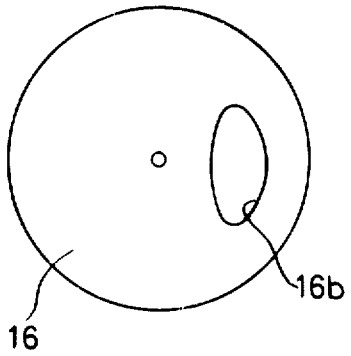

FIGS. 13*a* and 13*b* are sectional views illustrating examples of a rotating sound shielding plate which may be used in the system of FIG. 12.

Figure 14:
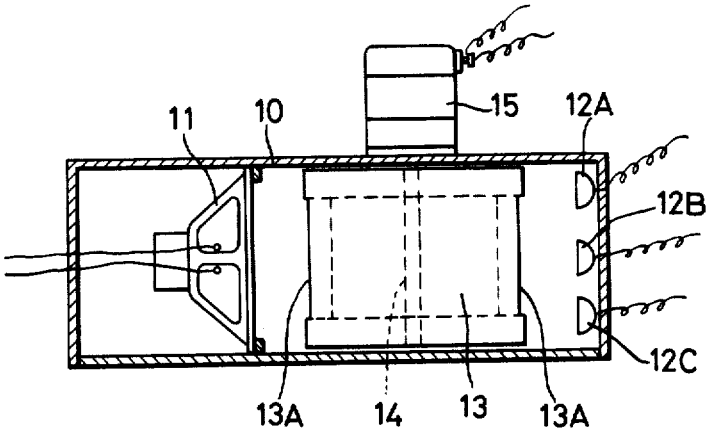
Figure 15:
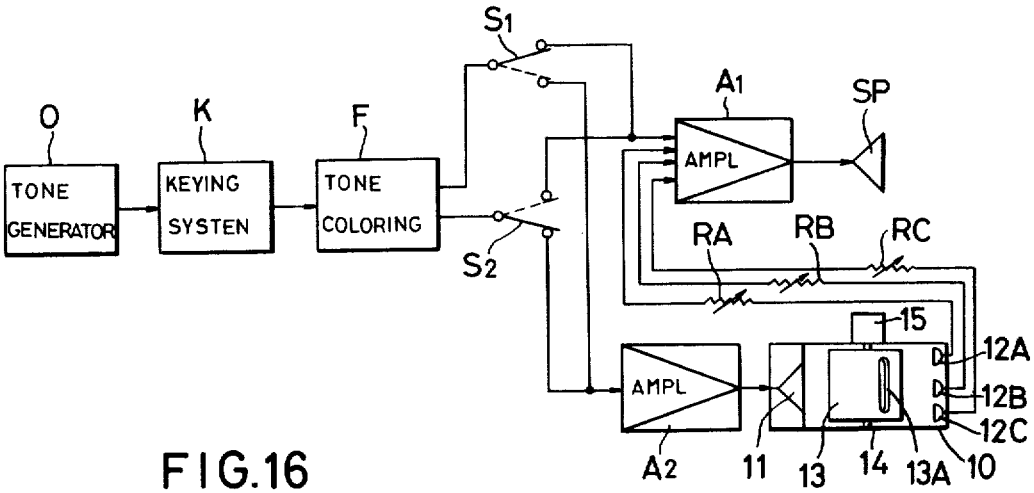
Figure 16:
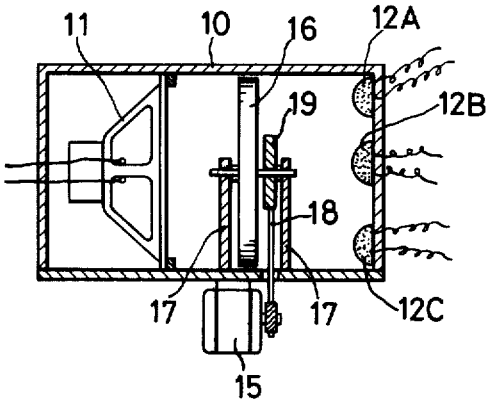

FIGS. 14, 15 and 16 are views of modifications of the embodiments shown in FIGS. 7, 11 and 12 respectively, where a plurality of microphones are employed.

Figure 17:
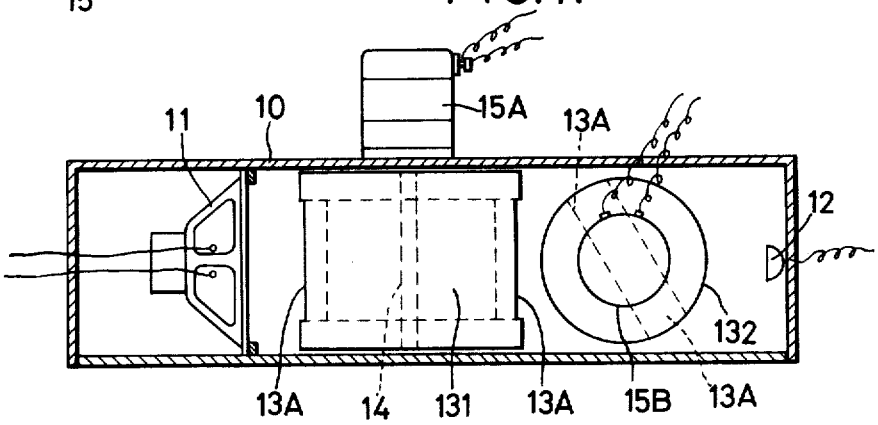
Figure 18:
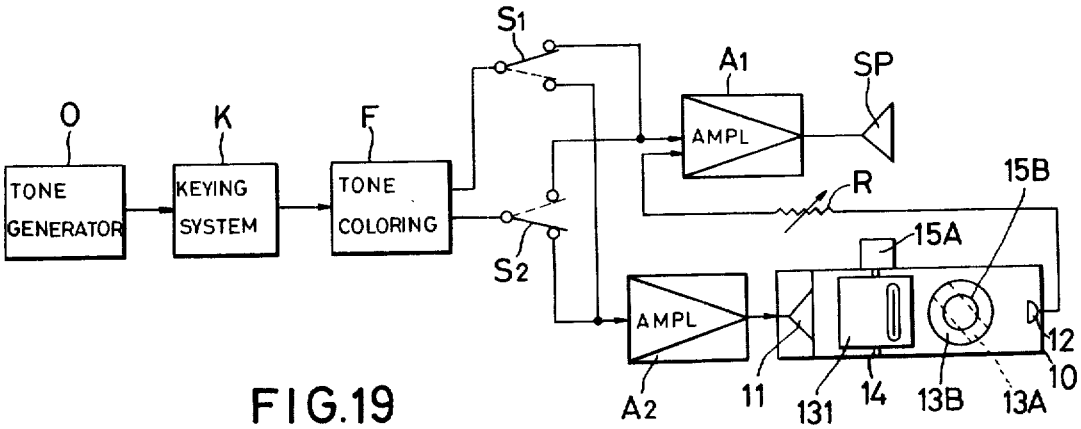
Figure 19:
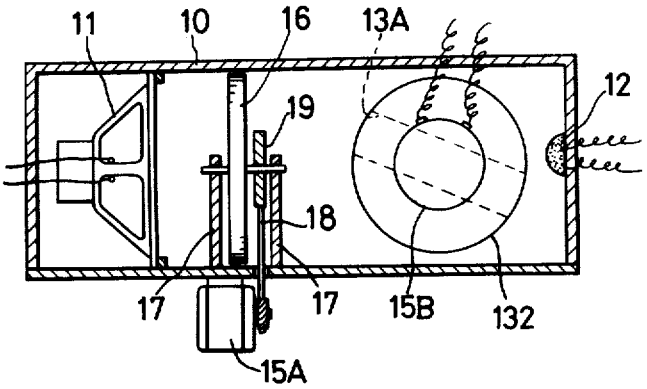

FIGS. 17, 18 and 19 are illustrations of other modifications of the constructions shown in FIGS. 7, 11 and 12, respectively, wherein a plurality of sound interrupting or modulating members are employed separately.

Figure 20:
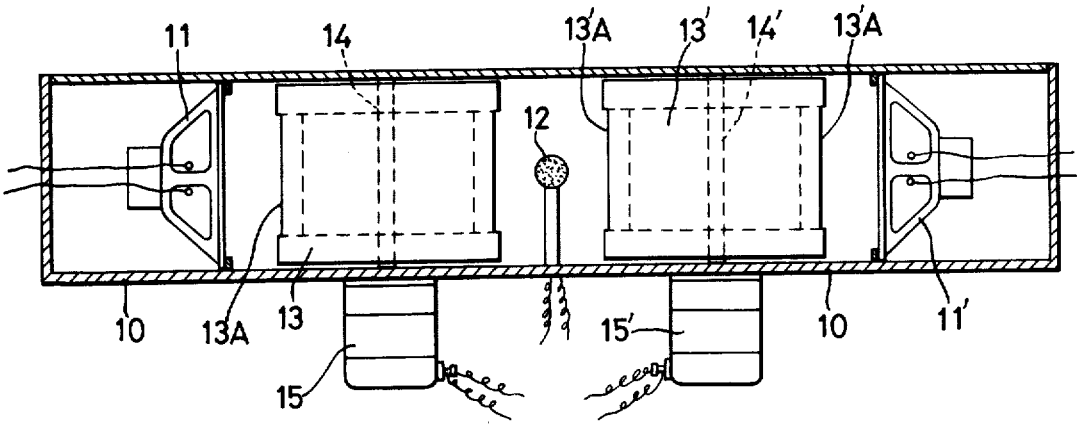
Figure 21:
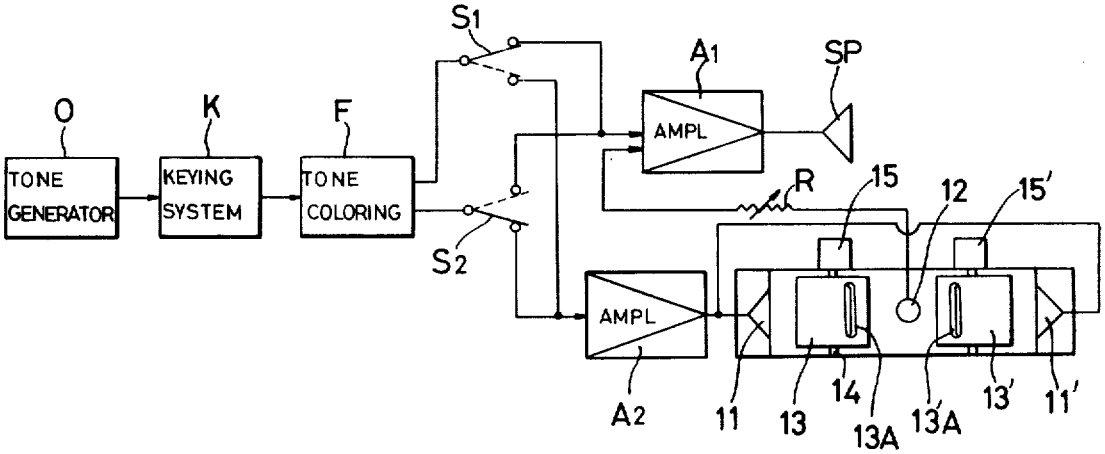
Figure 22:
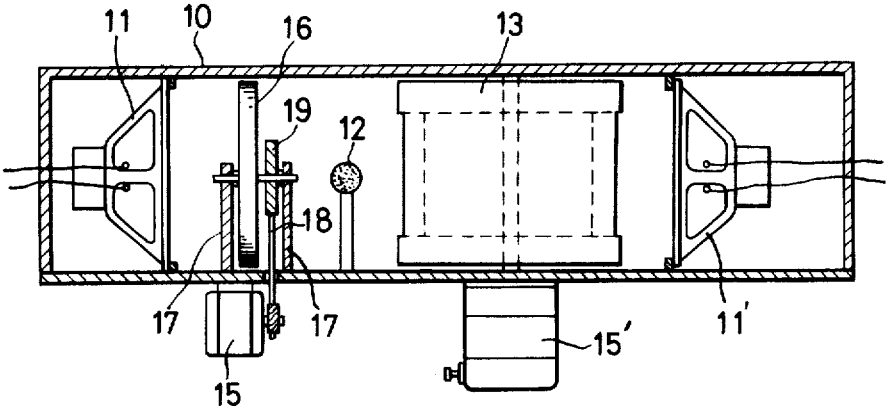

FIGS. 20, 21 and 22 are illustrations of further embodiments of the present invention which are developed from those of FIGS. 7, 11 and 12, respectively, wherein a plurality of sound interrupting members and loudspeakers are employed.

Figure 23:
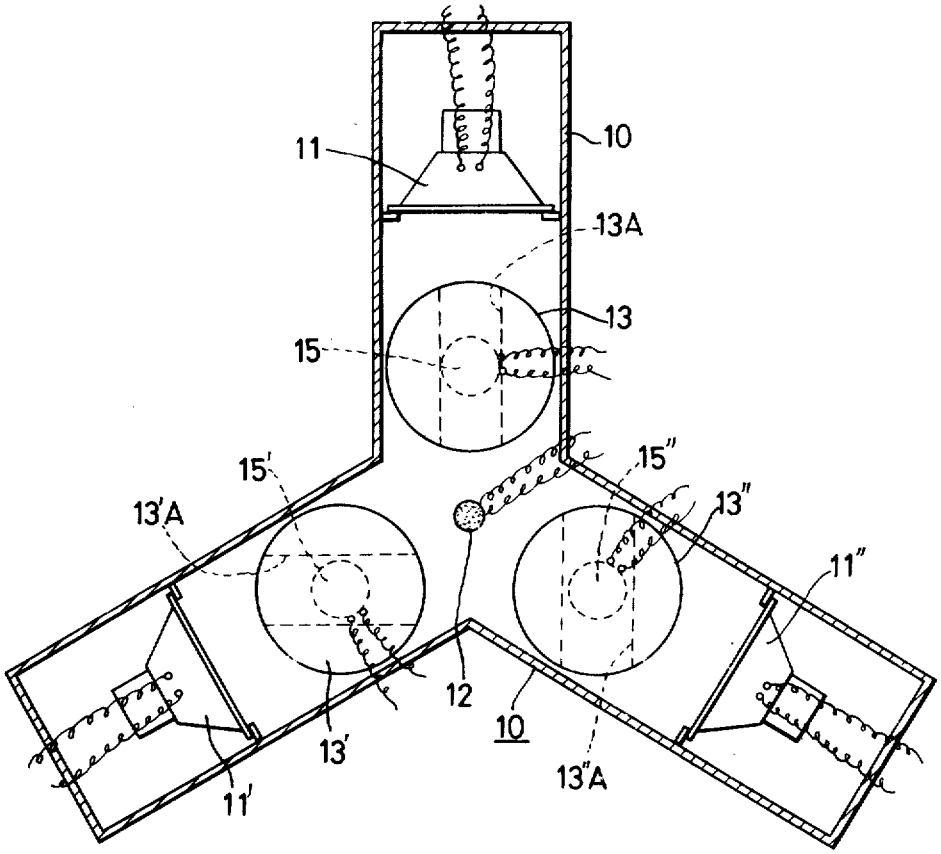

FIG. 23 is a section illustrating the structure of another embodiment of the present invention, wherein a microphone is disposed at the center of a Y-shaped housing whose respective branches accommodate a loudspeaker and a rotational sound shielding member for subjecting the sound to modulation.

Like reference numerals and letters indicate like parts throughout the embodiments of the invention.

DESCRIPTION OF THE PREFERRED EMBODIMENTS

Referring to FIGS. 7 through 11, a basic embodiment of the present invention will be described hereunder.

In FIG. 7, a basic construction of a tremolo effect producing system of the present invention is indicated in a section as viewed from the side to better understand the present invention, which comprises an acoustically sealed, closed housing 10 of an elongated shape and an electric motor 15 mounted outside thereof. The housing 10 includes therein a loudspeaker 11 positioned on the left side thereof and a microphone 12 on the right side, or for example, on the inner side wall of the housing 10. The sound radiating surface of the loudspeaker 11 and the sound pickup surface of the microphone 12 are arranged opposite to each other. A rotating cylindrical member 13 mounted on a rotatable shaft 14 is disposed between the loudspeaker 11 and the microphone 12. The cylindrical member 13 comprises symmetrically arranged opposite side walls 13*a* and 13*b* each forming an arc of a circle having a center at the shaft 14, and upper and lower walls 13*c* and 13*c*, respectively, fixed to the uppermost and lowermost ends of the side walls 13*a* and 13*b* as best seen in FIGS. 8*a* and 8*b*. The side walls 13*a* and 13*b* are formed not to constitute an entire circle, leaving openings 13*e* and 13*f* therebetween, as shown in FIG. 8*a*. These openings 13*e* and 13*f* are disposed at diametrically opposite points of said circle and are intercommunicated with each other through an open space 13*g* defined by the side walls 13*a* and 13*b* and upper and lower walls 13*c* and 13*b*. Thus, a sound passage 13A is formed in the cylindrical member 13 to pass sound therethrough. The shaft 14 is operatively connected with the driving shaft of the motor 15, so that the rotating member 13 also can be rotated by the motor at a speed of 0.5 to 15 revolutions per second. The rotational speed of the rotating member 13 can be easily controlled by electrically adjusting the drive motor. The appearance of the above-constructed system of the present invention is shown in general in FIG. 9.

The abovementioned rotating member 13 may be made of material such as a synthetic resin in the form of a cylindrical body and may have a cross section having various shapes of through-holes, as indicated in FIGS. 8*a* and 8*b* as well as in FIGS. 10*a* through 10*d*. That is, FIGS. 10*a* to 10*d* illustrate, in transverse section different forms of an opening or openings constituting a sound passage or sound passages 13A provided in a solid cylindrical body constituting the rotating member 13, respectively. The shape of the opening or openings is preferably symmetrical with respect to the rotating axis of the member 13 or the shaft 14.

In the operation of the abovementioned system of the present invention, when a low frequency current of a tone signal which is developed from, for example, an audio output terminal of an electronic musical instrument is supplied to the loudspeaker 11 accommodated in the housing 10 and when simultaneously therewith the rotating member 13 is rotated at a speed, preferably between 0.5 and 15 revolutions per second, the sound from the loudspeaker 11 is periodically transmitted through a sound passage or passage 13A of the member 13 provided on the side of the microphone 12 and is modulated with a tremolo effect in accordance with the rotational speed of the rotating member 13, and the thus modulated sound is picked up by the microphone, whereby an audio signal having a tremolo effect is obtained at the microphone 12.

The output signal of the microphone 12 is fed to a power amplifier of the electronic musical instrument as will be described hereinafter and is mixed with the aforesaid tone signal thereat and is reproduced by a loudspeaker of the instrument or a headphone, and thus, a reproduced sound wave will provide a tremolo effect as desired.

As will be appreciated from the above description, in the system of the present invention, a listener does not hear the sound from the loudspeaker 11 directly, but the sound is used to be acoustically modulated or processed and translated into an electrical signal having a required waveform to generate a tremolo effect. Accordingly, the loudspeaker 11 as a sound radiating means as well as the housing for accommodating it can have a substantially reduced size.

Referring to FIG. 11, there is shown a schematic circuit block diagram of an electronic musical instrument to which the system according to the present invention is applied, only by way of example. In the circuit construction, tone signals generated by known tone generators O are suitably keyed by a keying system K including a keyboard to select a required tone signal. The selected tone signal of a low frequency is passed through a tone coloring circuit F and applied, through two change-over switches $S_1$ and $S_2$ connected in parallel with an output terminal of the tone coloring circuit F, to a main amplifier $A_1$ and a sub-amplifier $A_2$ alternately. An output signal from the main amplifier $A_1$ is fed to a fixed loudspeaker SP which is usually called non-tremolo speaker, while an output signal delivered from the sub-amplifier $A_2$ is fed to the loudspeaker 11 accommodated in the closed housing 10. Sound reproduced by the loudspeaker 11 is modulated through a rotating sound interrupting member 13 and is picked up by the microphone 12 and is converted thereat to an electrical signal. Such an output signal of the microphone 12 is applied via a level adjusting circuit R such as a potentiometer, to the main amplifier $A_1$ and is mixed thereat with the output signal provided from the tone coloring circuit F.

Thus, a tone signal of a relatively low frequency band developed at the tone coloring circuit F is supplied via the change-over switch $S_1$ to the main amplifier $A_1$ as it is, and is reproduced by the loudspeaker SP, with the resulting sound wave not containing any tremolo effect. On the other hand, a tone signal of a relativly high frequency band delivered from the tone coloring F is fed, through the change-over switch $S_2$, to the sub-amplifier $A_2$ and is reproduced by the loudspeaker 11 of the tremolo effect producing system, and then the sound from the loudspeaker 11 is subjected to a tremolo effect by means of the sound interrupting member 13 being rotated and is translated by the microphone 12 into a tone signal with a tremolo effect. The thus obtained tone signal is applied, via the level adjusting circuit R, to the main amplifier $A_1$ and is reproduced by the fixed loudspeaker SP of the instrument substantially at the same time with the reproduction of the non-tremolo tone signal. Thus, the electronic musical instrument including the system according to the present invention can easily give a person who is listening to the music being played by the instrument a natural and pleasant feeling because of the thus produced tremolo effect.

Referring to FIGS. 12, 13*a* and 13*b*, another embodiment of the present invention which is modified from that of FIG. 7 will be described hereunder.

The housing 10 of FIG. 12 comprises therein a rotational disc plate 16 having cotouts 16*a* as shown in FIG. 13*a* or an opening or through-hole 16*b*, as shown in FIG. 13*b*, disposed between the loudspeaker 11 and the microphone 12. The disc plate 16 is rotatably supported by supports 17 through a shaft connected with the disc plate, and is operatively connected through a pulley 19 and a drive belt 18 with the motor 15 adapted to be driven by the motor at a speed similar to that of the abovementioned rotational member 13. The disc plate 16 is so disposed as to be rotated in a plane perpendicular to an axis along which the loudspeaker 11 and the microphone 12 face each other. In the housing of the abovementioned construction, the sound coming from the loudspeaker is subjected to a tremolo effect as the disc plate 16 is rotated at the abovementioned speed to periodically pass the sound from the speaker through the cutouts or opening, and the sound thus passed therethrough is picked up and translated by the microphone 12 into an audio signal with a tremolo effect. The signal may be processed and reproduced in a similar manner as described in the proceeding embodiment when used in an electronic musical instrument.

In the embodiments of FIGS. 7 and 12, the loudspeaker 11 may be movably mounted so as to thereby produce much complicated and much interesting tremolo effect. For example, by rotating the loudspeaker, a Doppler effect is added to that effect given by the rotation of the disc plate.

Referring to FIGS. 14 to 16, there are shown partial modifications of the constructions of FIGS. 7, 11 and 12, respectively, in which a plurality of separate pickup means such as microphones 12A, 12B and 12C are provided in the housing 10 in different positions on the side opposite to the loudspeaker 11.

Both the modified systems shown in FIGS. 14 and 16 have basically similar constructions and function as described previously except for the provision of plural microphones. The microphones 12A, 12B and 12C pick up, independently of each other, the sound delivered from the loudspeaker 11 which is modulated with complicated tremolo effects as the rotational member 13 or 16 is rotated, thus developing individual audio signals capable of producing different tremolo effects at their outputs.

FIG. 15 illustrates a schematic circuit block diagram representing a modification of FIG. 11 in which the system of FIG. 14 or 16 may be used. The modification, as shown in FIG. 15, comprises separate microphones 12A, 12B and 12C accommodated in the housing 10 in different positions, and level adjusting circuits such as potentiometers RA, RB and RC connected with the separate microphones at one end of each of the potentiometers respectively. The other end of each potentiometer is connected to an input terminal of the power amplifier $A_1$, so that audio signals having different waveforms and levels fed through the potentiometers RA, RB and RC from the separate microphones may be mixed at the amplifier $A_1$. Thus, since each microphone can pick up an input sound wave which is different in phase, amplitude and reflection, an output signal of the amplifier $A_1$ developed by mixing the thus obtained auido signals having different properties will cause sounds to be reproduced which have natural, delicate tremolo effects by means of the non-tremolo loudspeaker SP.

Referring to FIGS. 17 and 19, there are illustrated still other embodiments of the present invention, which generally employ in the closed housing a plurality of rotational sound shielding members having through-holes or cutouts therein as previously shown in FIG. 7 or 12.

In FIG. 17, reference numeral 10 indicates an elongated acoustically sealed box or housing. In the enclosed space of the housing 10 is disposed a loudspeaker 11 on the side of one end of the housing along the length thereof and a microphone 12 is positioned on the side of the other end. In the space of the housing located between the loudspeaker 11 and the microphone 12, a rotational member 131 having a sectional structure including a cylindrical shape with a sound passage 13A in cross section, as shown in FIGS. 8*a* and 8*b* for example, is provided so as to shield the sound generated by the loudspeaker 11 excluding the sound passage 13 A. The rotational member 131 is pivotably mounted on a shaft 14 which is rotated by a motor 15A. The shaft 14 is mounted on the housing 10 perpendicularly to the longitudinal axis of the housing 10. Between the member 131 and the microphone 12 another rotational member 132 having a similar structure as the member 131 is disposed with its rotating axis extending in a direction normal to that of the shaft 14 and is driven by another motor 15B. Both the rotational members 131 and 132 are rotated at the same or different speeds of 0.5 to 15 revolutions per second, separately, so that the sound fed from the loudspeaker 11 can be subjected to complicated wave modulations or complicated tremolo effects and then to be picked up and translated into an audio signal having properties corresponding to the modulated sound wave by the microphone 12.

FIG. 19 shows a modification of FIG. 17 in which the mechanism of the sound shielding member 131 is replaced by a rotational disc plate 16, supports 17, a pulley 19 and a belt 18 as shown in FIG. 12.

An application of the system as shown in FIG. 17 for an electronic musical instrument is illustrated in FIG. 18 only by way of example. The construction is principally similar to that of FIG. 11.

Referring now to FIGS. 20 and 23, further modifications of the present invention providing more sophisticated tremolo effects are indicated in side section, in which a closed housing 10 accommodates a plurality of acoustic transducers such as loudspeakers 11, 11' and 11'' with a distance spaced from each other, a sound pickup such as a microphone 12 positioned oppositely therebetween and a plurality of rotational sound shielding members 13, 13' and 13'' having through-holes or cutouts for passing sounds and disposed between each loudspeaker and the microphone. The members 13, 13' and 13'' are pivotably mounted on shafts 14, 14' and 14'' and are rotated by motors 15, 15' and 15'' at required speeds between 0.5 and 15 revolutions per second, respectively. The revolution ratio of these motors is preferably set so as not to be an integer. In a similar way as described previously, a low frequency input signal is applied to the respective loudspeakers enclosed in the housing 10 and the subjected to individual modulations through the respective members 13, 13+ and 13'' and received by the single microphone 12, thus resulting in an acousto-electrically converted signal at the output of the microphone, which signal is capable of producing desired tremolo effect through the sound reproducing means. In FIG. 20, two pairs of loudspeakers 11, 11' and sound modulating members 13, 13' are aligned opposite to each other, while three such pairs are arranged about the single microphone in a Y-like form in FIG. 23. More than three such pairs may be provided with respect to the single microphone if any more complicated tremolo effect is required to be obtained.

FIG. 21 shows a block diagram of an example of an electronic musical instrument to which the modified system shown in FIG. 20 is applied. The details of this example are omitted here because of the substantial similarity to FIG. 11.

FIG. 22 illustrates another modification of the present invention in which, as will be understood from the foregoing statement, the systems shown in FIGS. 7 and 12 are combined excepting the single microphone so that they may be opposed to each other about the single microphone.

I claim:

1. An improved tremolo effect producing system capable of being positioned within the carbinet of an organ comprising:

means for generating a plurality of tone signals, means for gating selected tone signals, tone coloring means for converting said gated tone signals to instrumental tones having intricate selective frequency characteristics, means for coupling at least a portion of said instrumental tones to a power amplifier, means for coupling at least a portion of said instrumental tone signals to an electroacoustical transducer, said electroacoustical transducer being positioned within a small enclosure, a plurality of low-power acousto-electrical transducers disposed in different positions opposite to said electroacoustical transducer in said small enclosure for converting the sound waves generated by said electroacoustical transducer to electrical signals, at least one relatively small rotational sound shielding member positioned in said enclosure, said member being rotated to periodically vary the sound waves transmitted in said small enclosure, means for rotating said sound shielding member, means connected to said plurality of acoustoelectrical transducers for coupling said electrical signals to said power amplifier, means for summing said electrical signals with said at least a portion of said instrumental tone signal, and means for converting said summed signals to high power sound waves.

2. The system according to claim 1 wherein said electroacoustical transducer and said acousto-electrical transducers are a loud speaker and microphones, respectively.

3. An improved tremolo effect producing system capable of being positioned within the cabinet of an organ comprising:

means for generating a plurality of tone signals, means for gating selected tone signals, tone coloring means for converting said gated tone signals to instrumental tones having intricate selective frequency characteristics, means for coupling at least a portion of said instrumental tones to a power amplifier, means for coupling at least a portion of said instrumental tone signals to an electroacoustical transducer, said electroacoustical transducer being positioned within a small enclosure, a low-power acousto-electrical transducer positioned in said small enclosure opposite said electroacoustic transducer for converting the sound waves generated by said electroacoustic transducer to an electrical signal, a plurality of relatively small rotational sound shielding members each disposed between said acoustoelectrical transducer and said electroacoustic transducer, each of said rotational sound shielding members periodically interrupting through rotation thereof the sound path from said electroacoustic transducer to said acousto-electrical transducer, said sound waves passing in series from said electroacoustic transducer through said sound shielding members to said acoustoelectrical transducer, means for rotating said sound shielding members, means for coupling said electrical signal to said power amplifier, means for summing said electrical signal with said at least a portion of said instrumental tone signal, and means for converting said summed signals to high power sound waves.

4. An improved tremolo effect producing system capable of being positioned within the cabinet of an organ comprising:

means for generating a plurality of tone signals, means for gating selected tone signals, tone coloring means for converting said gated tone signals to instrumental tones having intricate selective frequency characteristics, means for coupling at least a portion of said instrumental tones to a power amplifier, means for coupling at least a portion of said instrumental tone signals to a plurality of electroacoustical transducers, said electroacostical transducers being positioned within a small enclosure, a low-power acousto-electrical transducer disposed in said small enclosure opposite said electroacoustic transducers for converting the sound waves generated by said electroacoustic transducers to electrical signals, a plurality of rotational sound shielding members each disposed between said acousto-electrical transducer and said electroacoustic transducers with said acousto-electrical transducer being positioned between said rotational sound shielding members, each of said rotational sound shielding members periodically interrupting through rotation thereof the sound path from said at least one electroacoustic transducers to said acousto-electrical transducer, means for rotating said sound shielding members, means for coupling said electrical signal to said power amplifier, means for summing said electrical signal with said at least a portion of said instrumental tone signal, and means for converting said summed signals to high power sound waves.

5. An improved tremolo effect producing device capable of being positioned within the cabinet of an organ comprising:

means for coupling an electrical signal to an electroacoustical transducer, said electroacoustical transducer being positioned within a small enclosure, a plurality of low-power acousto-electrical transducers disposed in different positions in said small enclosure opposite said electroacoustic transducer for converting the sound waves generated by said electroacoustic transducer to a set of electrical signals, at least one relatively small rotational sound shielding member positioned in said enclosure, said member being rotated to periodically vary the sound waves transmitted in said small enclosure, and means for rotating said sound shielding member.

6. The system according to claim 5 wherein said electroacoustic transducer and said acousto-electrical transducers are a loud speaker and microphones, respectively.

* * * * *